US006360736B1

(12) United States Patent
Juan

(10) Patent No.: US 6,360,736 B1
(45) Date of Patent: Mar. 26, 2002

(54) AIR GUN FIRING SYSTEM

(75) Inventor: Chih-Chen Juan, Hsinchun Chiayi (TW)

(73) Assignee: Yung Che Cheng, Cha-Yi Hsien (TW)

( * ) Notice: Subject to any disclaimer, the term of this patent is extended or adjusted under 35 U.S.C. 154(b) by 0 days.

(21) Appl. No.: 09/507,222

(22) Filed: Feb. 18, 2000

(51) Int. Cl.[7] ..... F41B 11/00
(52) U.S. Cl. ..... 124/77; 124/73; 124/32
(58) Field of Search ..... 24/77, 32, 73, 24/72, 54, 82, 74

(56) References Cited

U.S. PATENT DOCUMENTS 5,967,133 A * 10/1999 Gardner, Jr. ..... 124/77
6,003,504 A * 12/1999 Rice et al. ..... 124/73
6,065,460 A * 5/2000 Lotuaco, III ..... 124/72

* cited by examiner

*Primary Examiner*—Peter M. Poon
*Assistant Examiner*—Florie C. Copier
(74) *Attorney, Agent, or Firm*—Pro-Techtor International Services

(57) ABSTRACT

An air gun firing system, working in conjunction with an air gun with a barrel and comprising: a bullet chamber on the front end of the main body, connected with the barrel for housing a bullet to be fired through the barrel; a lock, glidingly movable along the axis of the barrel, pushing the bullet into the bullet chamber, as driven by a lock driver, enabling the bullet to be fired, with a spring pulling back the lock; a gas chamber for driving the lock driver, accommodating the lock driver; a high-pressure gas container; a first pressure reducing valve; a second pressure reducing valve; and an electromagnetic valve, controlling flow of low-pressure gas into the gas chamber. When the electromagnetic valve opens, low-pressure gas flows into the gas chamber, driving the lock driver. When the electromagnetic valve closes, the spring pulls back the lock and the lock driver.

6 Claims, 5 Drawing Sheets

AIR GUN FIRING SYSTEM

BACKGROUND OF THE INVENTION

1. Field of the Invention

The present invention relates to an air gun firing system for use in an air gun.

2. Description of Related Art

Rifle shooting contests using air guns are a common recreational pastime. Air guns are divided into single-loaders and semiautomatic or fully automatic repeating guns.

A conventional air gun has a barrel with a bullet chamber, accommodating a bullet to be fired. A guiding tube is set on the barrel, guiding bullets that fall into the bullet chamber to be fired. However, the bullets have low weights and consequently fall into the bullet chamber only at a relatively low feeding rate. During continuous operation only a limited firing rate of bullets is possible, which is below 180 bullets per minute. A higher firing rate leads to attempted firing although the bullet to be fired has not yet entered the bullet chamber, so that automatic firing will be interrupted. Continuous firing of automatic repeating rifles is thus limited to the feeding rate of bullets into the bullet chamber, which is about 180 bullets per minute.

Conventional semi-automatic repeating air guns in principle work like gunpowder-driven rifles. A lock is driven back by gas pressure upon firing a bullet, which is a simple structure. However, since gas pressure directly drives the firing, firing is too fast with no way of being slowed. Therefore only one bullet can be fired at a time. Although semi-automatic repeating rifles have simple structures, restriction to firing of single bullets do not fulfill demands of users.

A conventional fully automatic repeating gun of another type has a bi-directional gas pressure vessel for driving bullets to be fired. Entering of gas into the gas pressure vessel is controlled by an electromagnetic control valve to achieve fully automatic repeated firing. Combining the control valve with the bi-directional gas pressure vessel allows to control the firing rate of the bullets and to stay within the limit set by the feeding rate of bullets.

However, since a bi-directional gas pressure vessel for driving bullets is used, this type of fully automatic repeating gun has a complicated structure, with the bullets occupying a large volume. Furthermore, after a bullet has entered the bullet chamber, the control valve is pushed by a firing device and opens, letting gas with high pressure into the bullet chamber to fire the bullet. Conventional control valves are not cast in a mold and do not allow to be tested for leaks before being used in air guns. Leaks detected only after having completed the air gun require the air gun to be disassembled and assembled again, which makes producing air guns difficult.

SUMMARY OF THE INVENTION

It is the main object of the present invention to provide an air gun firing system with a simple structure and fully automatic repeating operation.

Another object of the present invention is to provide an air gun firing system which does not require a bi-directional gas pressure vessel for simpler control.

A further object of the present invention is to provide an air gun firing system which has a control valve cast in a mold for better reliability.

The present invention can be more fully understood by reference to the following description and accompanying drawings.

DETAILED DESCRIPTION OF THE PREFERRED EMBODIMENT

Figure 1:
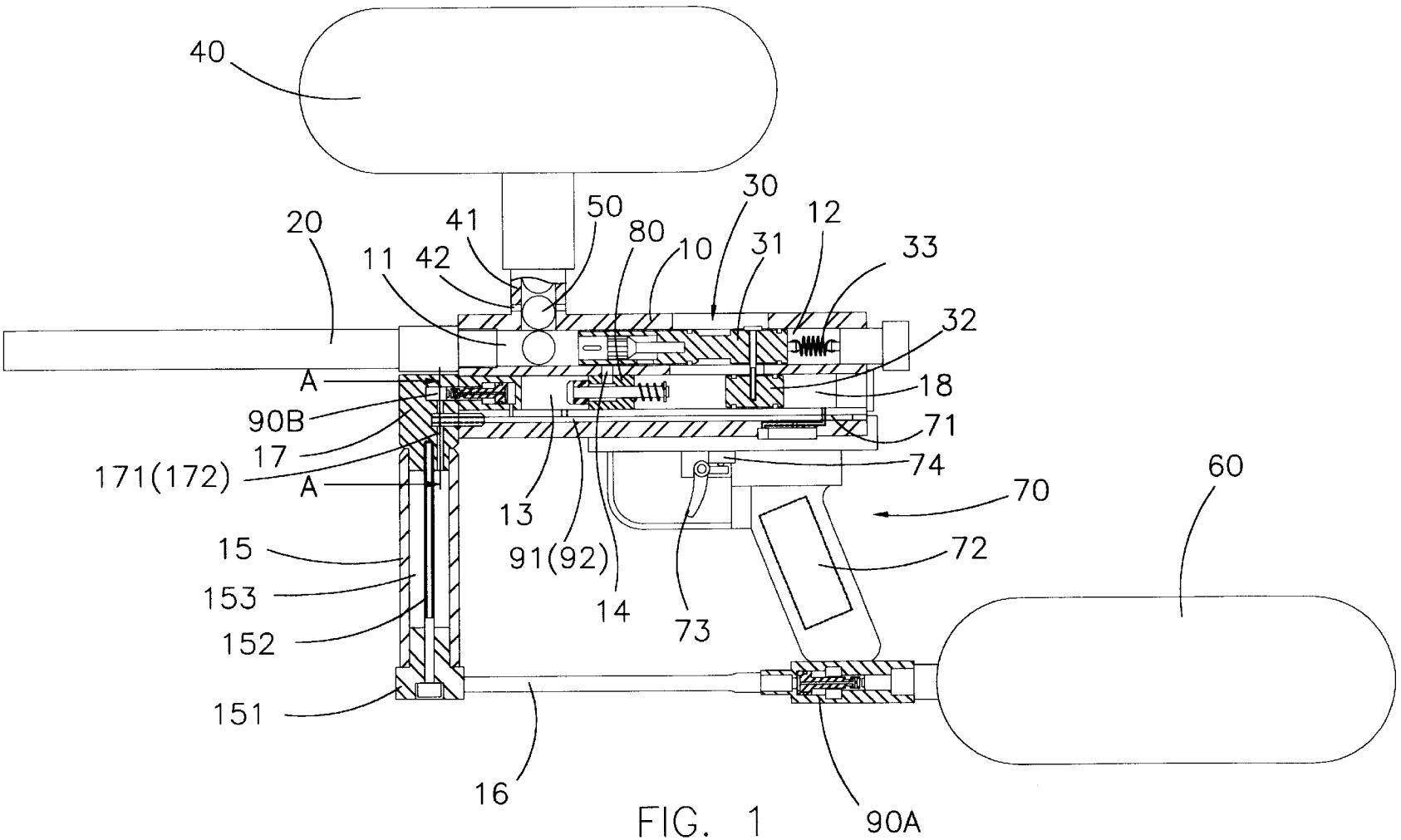
FIG. 1 is a sectional side view of the air gun firing system of the present invention in conjunction with an air gun.

As shown in FIG. 1, the air gun firing system of the present invention is used in conjunction with an air gun, having a main body 10 with an upper side, a lower side, a front end and a rear end, defining a longitudinal direction, with a bullet chamber 11 located at the front end of the main body 10; a barrel 20, having a rear end that is attached to the front end of the main body 10; and a feeding mechanism 40 on the upper side of the main body 10, feeding further bullets into the bullet chamber 11 to be fired from there.

The air gun firing system of the present invention mainly comprises: a firing device 30 inside the main body 10, controlling firing of a bullet 50 from the bullet chamber 11; a high-pressure gas container 60, supplying gas for driving the bullets 50 to be fired; a trigger device 70; a control valve 80; a first pressure reducing valve 90A; and a second pressure reducing valve 90B. The trigger device 70 has an electromagnetic valve 71, an electric control circuit 72, and a trigger 73. The control valve 80, upon being pushed by the firing device 30, opens, allowing compressed gas to flow into the bullet chamber 11, pushing out the bullet 50. The first pressure reducing valve 90A passes on pressure from the high-pressure gas container 60 reduced to medium pressure for driving the bullet 50. The second pressure reducing valve 90B reduces further gas pressure to low pressure, a level borne by the electromagnetic valve 71 and required by the firing device 30.

Referring again to FIG. 1, the bullet chamber 11 in the main body 10 is connected with the barrel 20 at the rear end thereof. A feeding tube 41, having a lower end, leads to the bullet chamber 11 to feed bullets into the bullet chamber 11. The feeding tube 41 close to the lower end thereof has several vents 42, allowing gas that has entered the feeding tube 41 to escape to prevent bullets to enter the bullet chamber 11 without being driven back by gas.

An accommodation chamber 12 is located inside the main body 10 to the rear of the bullet chamber 11, accommodating the firing device 30. A medium-pressure chamber 13 is located inside the main body 10 below the bullet chamber 11. Gas coming from the first pressure reducing valve 90A enters the medium-pressure chamber 13. The control valve 80 in a connecting opening 14 connects the medium-pressure chamber 13 and the bullet chamber 11, controlling entering of gas with medium pressure into the bullet chamber 11 for firing the bullet 50 through the barrel 20.

As further shown in FIG. 1, the high-pressure gas container has an outlet which is connected with the first pressure reducing valve 90A, from where gas with medium pressure is led into the medium-pressure chamber 13. A gas tube 15 is attached to the main body 10 from below at the front end thereof, having a free end. A conduit 16 connects the first pressure reducing valve 90A with the gas tube 15 at the free end thereof. A gas-conducting block 17 leads gas from the gas tube 15 into the medium-pressure chamber 13, establishing a connection with a gas flow circuit inside the main body 10 (further explained below). Thus gas with medium pressure is led from the first pressure reducing valve 90A into the medium-pressure chamber 13.

Referring to FIGS. 1–5, the gas-conducting block 17 leads gas with medium pressure into the medium-pressure chamber 13 and, besides this, to the second pressure reducing valve 90B. Gas entering the second pressure reducing valve 90B undergoes another reduction of pressure to low pressure and subsequently is led through several conducting openings to the electromagnetic valve 71. Gas having passed through the electromagnetic valve 71 drives the firing device 30.

Pressure inside the high-pressure gas container 60 usually is about 1200 psi and is reduced by the first pressure reducing valve 90A to about 800 psi, which are needed to fire the bullet 50. Since the electromagnetic valve 71 cannot stand too high a pressure (of more than 180 psi), a passage inside the main body 10 (further explained below) reduces pressure accordingly to reach the electromagnetic valve 71.

The firing device 30 comprises: a lock 31 with a front end, a rear end and a lower side, glidingly movable inside the accommodation chamber 12 in the longitudinal direction between a rear position and a forward position, pushing the bullet 11 into the bullet chamber 11 and sealing the bullet chamber 11; a lock driver 32, attached to the lock 31 on the lower side thereof and cylindrically shaped with an axis along the longitudinal directions; and a spring 33. The lock driver 32 is driven by low-pressure gas passing through the electromagnetic valve 71 and drives the lock 31 in a forward movement. The spring 33 pulls back the lock 31 and the lock driver 32 to the rear positions thereof after the bullet 50 has been fired.

Figure 2:
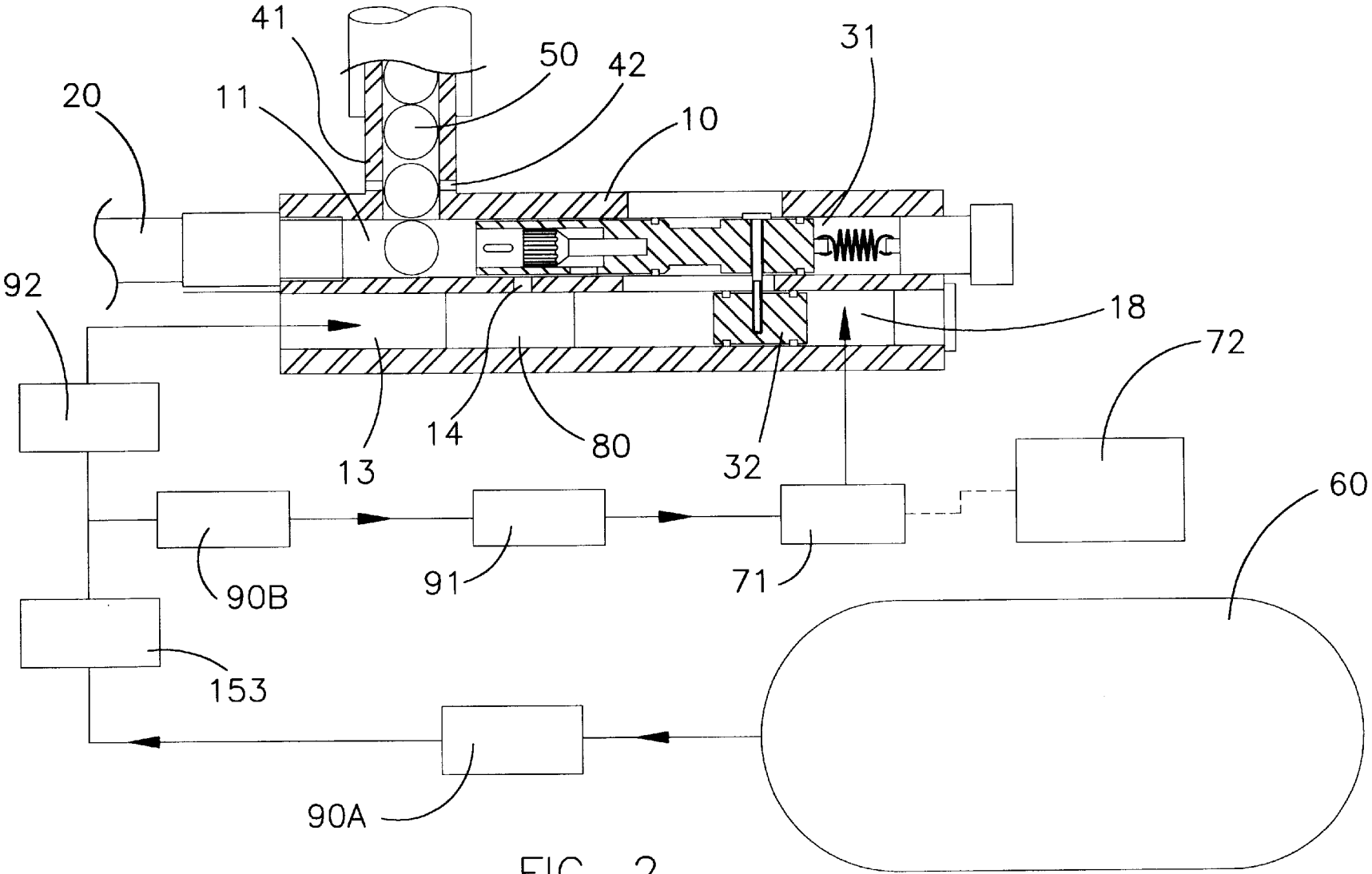
FIG. 2 is a schematic illustration of the air gun firing system of the present invention in conjunction with an air gun.
Figure 3:
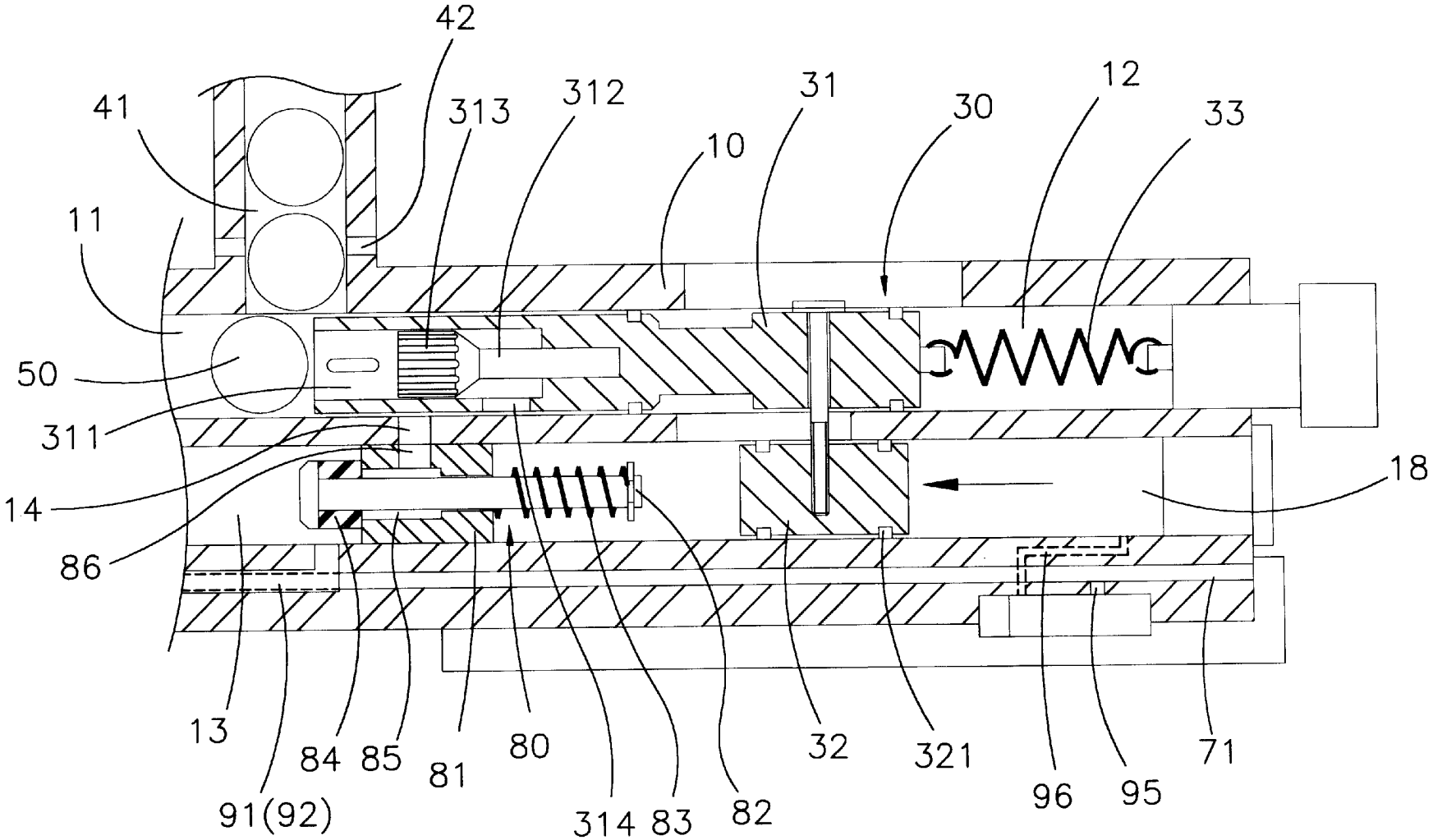
FIG. 3 is a schematic illustration of the movement of the present invention before firing a bullet.

Referring to FIGS. 1–3, the main body 10 has a gas chamber 18 with an inner wall, located below the accommodating chamber 12 and accommodating the lock driver 32. At least one sealing ring 321 is laid around the lock driver 32, gliding along the inner wall of the gas chamber when the lock driver 32 moves. As shown in FIG. 2, gas from the high-pressure gas container 60, after passing through the first and second pressure reducing valves 90A, 90B, reaches the electromagnetic valve 71 through a conduit 91.

Referring again to FIG. 5, the electromagnetic valve 71 has at least one inlet 711, an outlet 712, and a vent 713. The inlet 711 is connected with the conduit 91, allowing low-pressure gas to reach the electromagnetic valve 71. When the electromagnetic valve 71 is open, the at least one inlet 711, the outlet 712 and the vent 713 are all connected, so that gas, after entering through the inlet 711 flows out through the outlet 712.

Figure 4:
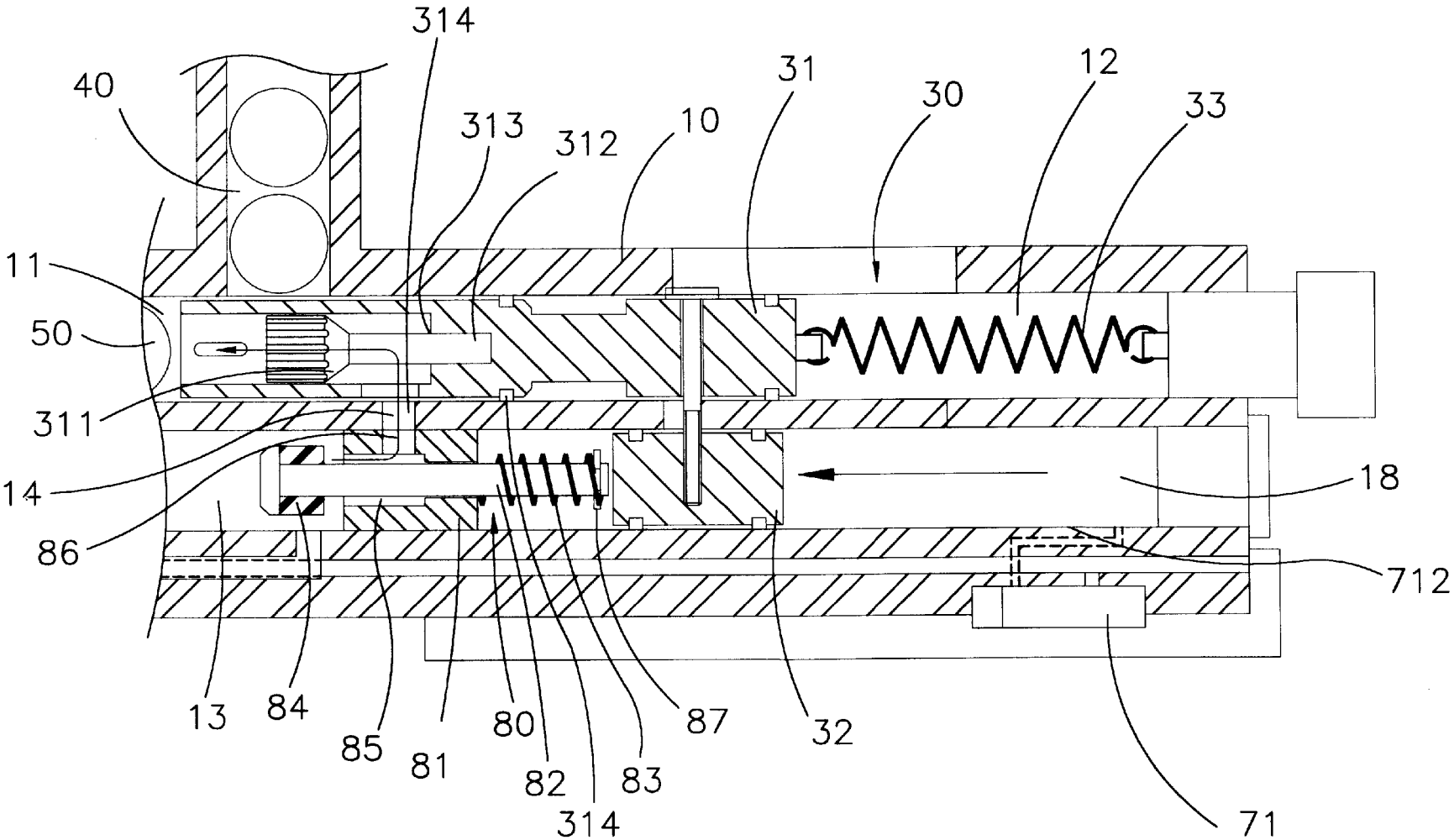
FIG. 4 is a schematic illustration of the movement of the present invention during firing of a bullet.
Figure 5:
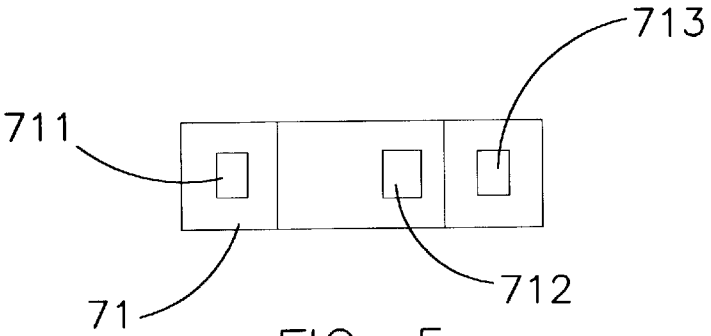
FIG. 5 is a top view of the control valve of the present invention, showing the inlet and the outlet thereof.

As shown in FIG. 2, the outlet 712 of the electromagnetic valve 71 is connected with the gas chamber 18. Therefore, when the electromagnetic valve 71 is open, low-pressure gas coming from the second pressure reducing valve 90B enters the gas chamber 18, driving the lock driver 32 (as shown in FIG. 4).

Referring to FIGS. 1 and 2, the electromagnetic valve 71 is controlled by the electric control circuit 72 to open or close. The electric control circuit 72 has a switch 74 which is operated by the trigger 73. When the trigger 73 is manually pulled, the electromagnetic valve 71 is opened or closed, so that firing the bullet 50 is manually controlled.

The electric control circuit 72 generates an acoustic signal which is sent out at a controlled rate after pulling the trigger 73, with the electromagnetic valve 71 opening and closing at the controlled rate. Thus, on pulling the trigger 30, the firing device 30 starts to operate repeatedly, and fully automatic repeating operation of the air gun is achieved.

The lock 31 of the firing device 30 serves to push the bullet 50 into the bullet chamber 11 and to seal the bullet chamber 11 at the rear end thereof, so that, when medium-pressure gas enters the bullet chamber 11, the bullet 50 will be pushed through the barrel 20. The spring 33 is fastened to the rear end of the lock 31 and thus expanded when the lock 31 moves forward (as shown in FIG. 4), developing an elastic force that pulls the lock 31 back as soon as no gas in the gas chamber 18 has a driving force anymore.

Furthermore, as shown in FIG. 3, the lock 31 on the front end thereof has an opening 311 with an inner peripheral wall in which a lock head 312 is inserted. The lock head 312 has a periphery close to the inner peripheral wall of the opening 311, leaving several gas paths 313 in between. A bottom hole 314 on the lower side of the lock 31 allows gas to enter the opening 311.

As shown in FIG. 4, when the lock 31 moves forward, pushing the bullet 50 into the bullet chamber, the front end thereof seals the bullet chamber 11 at the rear end thereof. At this time, the bottom hole 314 of the lock 31 is aligned with the connecting opening 14 between the medium-pressure chamber 13 and the bullet chamber 11. Then, gas in the medium-pressure chamber 13 is enabled to enter the opening 311 of the lock through the connecting opening 14 and the bottom hole 314 and subsequently passes through the gas paths 313 around the lock head 312, entering the bullet chamber 11 to drive out the bullet 50 through the barrel 20.

Furthermore, as shown in FIG. 3, while the lock 31 has not yet sealed the bullet chamber 11, the control valve 80 is closed. When the lock 31 has moved forward, sealing the bullet chamber 11, the control valve is pushed open by the lock driver 32, allowing gas from the medium-pressure chamber 13 to flow to the connecting opening 14 and from there to the bullet chamber 11.

As shown in FIGS. 3 and 4, the control valve 80 comprises: a valve body 81 with a top side and a front side, into which an opening 85 is cut; a pushing rod 82, glidingly movable in the valve body 81 along the longitudinal direction, passing through the opening 85; a spring 83 on the pushing rod 82, leaning against the valve body 81; and a plug 84 on the front end of the pushing rod 84. The pushing rod 82 has a rear end that points to the lock driver 32. A top hole 86, cut into the top side of the valve body 81 connects the opening 85 with the connecting opening 14, establishing a connection between the medium-pressure gas chamber 13 and the connecting hole 14.

The pushing rod 82 has a holding ring 87 on the rear end thereof. The spring 83 is inserted between the holding ring 87 on the pushing rod 82 and the valve body. Thus the spring 83 is held on the pushing rod 82, so that the valve body 81, the pushing rod 82 and the spring 83 form a unit which will not disintegrate and are easy to mount.

As shown in FIG. 3, when the pushing rod 82 is in a rearmost position, the plug 84 covers and seals the opening 85, closing the control valve 80, such that no gas from the medium-pressure chamber 13 will enter the bullet chamber 11. When pushed by the lock driver 32, as shown in FIG. 4, the pushing rod 82 moves forward, lifting the plug 84 from the opening 85 and allowing gas to pass through the opening 85 and the top hole 86 to reach the connecting opening 14 and from there the bullet chamber 11 to drive out the bullet 50.

As compared to a conventional firing device, the firing device 30 of the present invention is mainly characterized by a movement that is caused by gas pressure driving the lock driver 32 from the rear position thereof. In the forward position of the lock 31 and the lock driver 32, the electromagnetic valve 71 cuts flowing of gas into the gas chamber 18, which causes the lock 31 and the lock driver 32 to be drawn back to the rear position thereof by the spring 33. Thus the present invention does not need to employ a bi-directional gas container and still achieves fully automatic repeating operation with a simple structure and low cost.

Since the firing device 30 has only unidirectional driving by gas for repeating operation, gas pressure from a single direction is sufficient, and no bi-directional gas pressure with a corresponding distribution system is needed, greatly simplifying the structure of the firing device 30.

Conventional pressure reducing devices usually employ mechanical valves, therefore refilling gas used up for firing bullets is often not sufficient, leading to a decreasing pressure at repeating operation and consequently to insufficient firing rates and impaired stability of repeating operation.

In order to solve this problem, the present invention has storage spaces inserted between the first and second pressure reducing valves 90A, 90B and the bullet chamber 11 and the gas chamber 18, respectively. Thus, pressure stored in the storage spaces compensates insufficient refilling by the first and second pressure reducing valves 90A, 90B due to a high firing rate.

The present invention has a gas distribution system as follows: As shown in FIGS. 1 and 2, gas flows from the first pressure reducing valve 90A into the gas tube 15. The gas tube 15 is a hollow tubular body with a connected end that is connected to the gas-conducting block 17. From the free end of the gas tube 15, a plug 151 is inserted therein, connected with the gas-conducting block 17 by a screw 152, so that the gas tube is fastened to the gas-conducting block 17 from below. The gas tube 15 has an inner space that forms a storage space 153, taking in gas from the first pressure reducing valve 90A.

Figure 6:
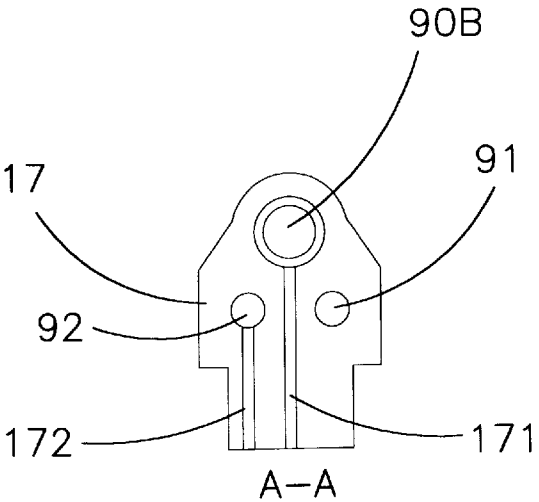
FIG. 6 is a cross-sectional view of the front section of the air gun used in conjunction with the present invention, showing the path of gas.

Referring to FIGS. 1 and 6, the gas-conducting block 17 has a rear side, a lower side and an upper side with an opening that is aligned with the medium-pressure chamber 13 and accommodates the second pressure reducing valve 90B. Below the medium-pressure chamber 13 and the second pressure reducing valve 90B two conduits pass through the main body 10 in the longitudinal direction. The conduit 91 conducts low-pressure gas from the second pressure reducing valve 90B, and the conduit 92 conducts medium-pressure gas.

As shown in FIG. 6, two exit ducts 171, 172 lead away from the upper side of the gas-conducting block 17. The exit duct 171 connects the lower side of the gas-conducting block 17 and the second pressure reducing valve 90B, allowing gas from the storage space 153 to enter the second pressure reducing valve 90B. The exit duct 172 connects the lower side of the gas-conducting block 17 and the conduit 92, allowing gas from the storage space 153 to enter the conduit 92.

Figure 7:
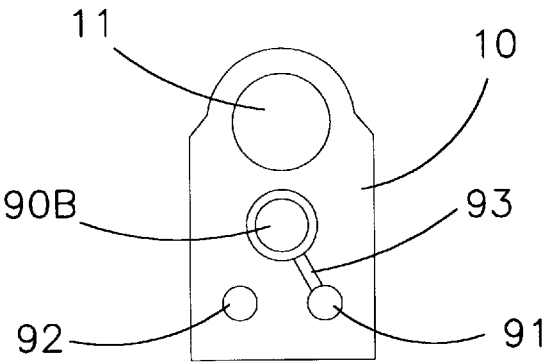
FIG. 7 is a cross-sectional view of the middle section of the air gun used in conjunction with the present invention, showing the path of gas of low pressure from the second pressure reducing valve to the first conduit.

As shown in FIGS. 1 and 7, a low-pressure gas outlet 93 on the rear side of the gas-conducting block 17 connects the second pressure reducing valve 90B and the conduit 91. The conduit 91 leads from the front end to the rear end of the main body 10. The electromagnetic valve 71 is located below the gas chamber 18. A duct 95 close to the rear end of the main body 10 connects the conduit 91 with the inlet 711 of the electromagnetic valve 71, and a duct 96 connects the outlet 712 of the electromagnetic valve 71 with the gas chamber 18. Thus gas from the second pressure reducing valve 90B is able to enter the gas chamber 18 and to drive forward the lock driver 32.

Figure 8:
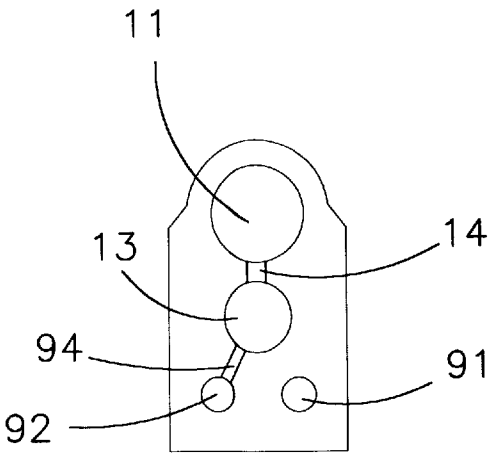
FIG. 8 is a cross-sectional view of the middle section of the air gun used in conjunction with the present invention, showing the path of gas of medium pressure from the second pressure reducing valve to the medium pressure chamber.

Furthermore, as shown in FIG. 8, medium-pressure gas from the storage space 153 enters the conduit 92 through the duct 172, with the conduit 92 located below the medium-pressure chamber 13. A duct 94 connects the conduit 92 and the medium-pressure chamber 13, allowing medium-pressure gas to enter the medium-pressure chamber 13. As shown in FIG. 3, the control valve 80 is located on the rear end of the medium-pressure chamber 13, controlling flow of gas to the connecting opening 14 to reach the bullet chamber 11.

With the storage space 153, the conduits 91, 92 and the medium-pressure chamber 13 having gas-storing capabilities, pressure decreases during repeating operation of the air gun are attenuated, allowing to maintain a high firing rate.

While the invention has been described with reference to a preferred embodiment thereof, it is to be understood that modifications or variations may be easily made without departing from the spirit of this invention which is defined by the appended claims.

What is claimed is:

1. An air gun firing system comprising:

a main body, a barrel with a front end and a rear end, a bullet chamber on said front end of said main body, said bullet chamber is connected with said rear end of said barrel for housing a bullet to be fired through said barrel, a lock having a rear end and glidingly movable along a longitudinal axis of said barrel, said lock pushing said bullet into said bullet chamber when said lock is moved forward from a rear position, said lock sealing said bullet chamber when said lock is moved forward, thereby enabling said bullet to be fired, a lock driver attached to said lock, a spring attached to said lock and to said main body, said spring returning said lock and said lock driver to an initial position after said bullet has been fired, a gas chamber housing said lock driver such that said lock driver is movable within said gas chamber parallel to said longitudinal axis of said barrel, and a gas supply system, said gas supply system supplying gas to drive said lock driver and to fire said bullet.

2. The air gun firing system according to claim 1, wherein:

said air gun firing system further comprises a high pressure gas container, a first pressure reducing valve to convert gas supplied by said high-pressure gas container to medium-pressure gas, a medium-pressure chamber that is supplied by said first pressure reducing valve and supplying said bullet chamber with said medium-pressure gas, a second pressure reducing valve to converting said medium-pressure gas supplied by said first pressure reducing valve to low-pressure gas, and a control valve between said first pressure reducing valve and said bullet chamber to control flow of said medium-pressure gas into said bullet chamber; wherein said control valve comprises a valve body having a front side facing said medium-pressure chamber, said front side of said valve body comprises an opening, a pushing rod glidingly movable in said valve body in a direction of said longitudinal axis, said pushing rod passing through said opening, said pushing rod having a rear end with a holding ring set on said rear end of said pushing rod, a plug on said front end of said pushing rod tightly covering said opening when said pushing rod is in a retracted position, and a spring on said pushing rod positioned between said valve body and said holding ring, said spring urging said pushing rod towards said retracted position; and wherein wherein said control valve is opened by said lock driver when said lock is moved forward.

3. An air gun firing system comprising:

a main body a barrel with a front end and a rear end, a bullet chamber on said front end of said main body, said bullet chamber is connected with said rear end of said barrel for housing a bullet to be fired through said barrel, a firing device movable parallel to a longitudinal axis of said barrel, said firing device pushes said bullet into said bullet chamber, thereby enabling said bullet to be fired, and a spring deployed between said firing device and said main body, said spring returning said firing device to an initial position after said bullet has been fired.

4. The air gun firing system according to claim 3, wherein:

said air gun firing system further comprises a gas chamber to drive said firing system, a high-pressure gas container, a first pressure reducing valve to convert gas supplied by said high-pressure gas container to medium-pressure gas, a medium-pressure chamber that receives said medium-pressure gas from said first pressure reducing valve and supplies said bullet chamber with said medium-pressure gas, a second pressure reducing valve, converting said medium-pressure gas supplied by said first pressure reducing valve to low-pressure gas, a control valve between said first pressure reducing valve and said bullet chamber to control a flow of said medium-pressure gas into said bullet chamber, said control valve being opened by said firing system so as to allow said medium-pressure gas to flow into said bullet chamber, and an electromagnetic valve to control a flow of said low-pressure gas into said gas chamber, with a storage space receiving said medium-pressure gas from said first pressure reducing valve and supplying said second pressure reducing valve and said medium-pressure chamber.

5. The air gun firing system according to claim 4, wherein:

a conduit is inserted between said second pressure reducing valve and said electromagnetic valve, said conduit storing said low-pressure gas about to enter said electromagnetic valve to drive said firing system.

6. An air gun firing system according to claim 4, wherein:

a conduit is inserted between said storage space and said medium-pressure chamber, said conduit storing said medium-pressure gas about to enter said medium-pressure chamber to fire said bullet.

* * * * *